US006241803B1

(12) United States Patent
Fuji

(10) Patent No.: US 6,241,803 B1
(45) Date of Patent: Jun. 5, 2001

(54) METHOD FOR MANUFACTURING REDUCED IRON PELLETS

(75) Inventor: Kojiro Fuji, Osaka (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 0 days.

(21) Appl. No.: 09/487,178

(22) Filed: Jan. 19, 2000

(30) Foreign Application Priority Data

Jan. 20, 1999 (JP) ..... 11-011973

(51) Int. Cl.[7] ..... C21B 13/00
(52) U.S. Cl. ..... 75/425; 75/504; 75/711
(58) Field of Search ..... 75/425, 504, 711

(56) References Cited

U.S. PATENT DOCUMENTS 5,930,579 * 7/1999 Nagumo et al. ..... 75/765

FOREIGN PATENT DOCUMENTS

| | | |
|---|---|---|
| 835537 | 5/1960 | (GB) . |
| 1 320 222 | 6/1973 | (GB) . |
| 6-316718 | 11/1994 | (JP) . |
| 10-158710 | 6/1998 | (JP) . |
| 10-237519 | 9/1998 | (JP) . |
| 10-317033 | 12/1998 | (JP) . |
| 11-050120 | 2/1999 | (JP) . |
| 11-106814 | 4/1999 | (JP) . |
| WO 96/23081 | 8/1996 | (WO) . |

OTHER PUBLICATIONS

Derwent Publications, AN 1992–118469, JP 04 059933, Feb. 26, 1992.
Derwent Publications, AN 1973–60997U, SU 368 314, 1973, No Month.
Derwent Publications, AN 1991–005587, SU 1 562 357, May 7, 1990.

* cited by examiner

*Primary Examiner*—Melvyn Andrews
(74) *Attorney, Agent, or Firm*—Oblon, Spivak, McClelland, Maier & Neustadt, P.C.

(57) ABSTRACT

A method for manufacturing reduced iron pellets comprises the steps of heating iron oxide pellets incorporating carbonaceous material to yield reduced iron pellets having an apparent density of not more than 4.0 g/cm$^3$, cooling the hot reduced iron pellets by using water at an average cooling rate between 1,500° C./min and 500° C./min, when the surfaces of the reduced iron pellets are cooled from 650° C. to 150° C. The method described above does not require expensive facilities for processing briquettes and can manufacture the reduced iron pellets having high degree of metallization, superior crushing strength, and an apparent density of not more than 4.0 g/cm$^3$.

3 Claims, 3 Drawing Sheets

METHOD FOR MANUFACTURING REDUCED IRON PELLETS

BACKGROUND OF THE INVENTION

1. Field of the Invention

The present invention relates to a method for manufacturing reduced iron pellets.

2. Description of the Related Art

A method for manufacturing reduced iron briquettes in Japanese Unexamined Patent Application Publication No. 6-316718 discloses a process for cooling the hot reduced iron briquettes. In the unexamined patent mentioned above, the reduced iron briquettes are slowly cooled to a temperature range of 350° C. to 250° C., by spraying water at a cooling rate between 150° C./min and 250° C./min, and the briquettes are then quenched by using cooling water. Another process in the unexamined patent is slowly cooling the reduced iron briquettes to a temperature range of 350° C. to 250° C., by using gas at a cooling rate between 150° C./min and 250° C./min, and the briquettes are then quenched using cooling water. Still another process in this unexamined patent is slowly cooling the reduced iron briquettes to 620° C. to 550° C. by using an inert gas, followed by spraying water to cool the briquettes to a temperature range of 350° C. to 250° C. at a cooling rate between 150° C./min and 250° C./min, and the briquettes are then quenched by cooling water.

Japanese Unexamined Patent Application Publication No. 10-158710 discloses a method for manufacturing reduced iron pellets by cooling hot reduced iron pellets discharged from a rotary kiln. According to the unexamined patent mentioned above, the reduced iron pellets are slowly cooled to 600° C. at a cooling rate of not more than 500° C./min. Through the cooling process described above, reoxidized films are formed on the surfaces of the reduced iron pellets. Since the reoxidized films are very dense and prevent the reduced iron pellets from being penetrated by moisture and oxygen, the reoxidized films can prevent reoxidation of the reduced iron pellets when they are stored for a long period of time. However, it is difficult to form the reoxidized films on the surfaces of reduced iron pellets discharged from rotary kilns only by air cooling.

When the reduced iron is processed to form briquettes such as those disclosed in Japanese Unexamined Patent Application Publication No. 6-316718, there are problems in the high expensive cost of providing facilities for processing briquettes and the high operating costs thereof. Therefore, it is preferable to cool the reduced iron and recover it in the form of pellets. However, since reduced iron pellets differ from reduced iron briquettes in size and characteristics, the method disclosed in Japanese Unexamined Patent Application Publication No. 6-316718 cannot be applied to pellets as written for briquettes.

In addition, when hot reduced iron pellets are quenched by cooling water, crushing strength thereof decreases by approximately 10 to 20 kg/cm$^2$; however, decrease in degree of metallization thereof is not significant. A method for cooling the reduced iron pellets received in containers, such as a hopper, by using nitrogen or the like, has the problem in that the cooling facilities are expensive.

SUMMARY OF THE INVENTION

Accordingly, it is an object of the present invention to provide a method for manufacturing reduced iron pellets having superior crushing strengths and high degree of metallization, which can be performed using inexpensive facilities.

To this end, a method of the present invention is provided for manufacturing reduced iron, comprising the steps of heating iron oxide pellets incorporating carbonaceous material to yield the reduced iron pellets having an apparent density of not more than 4.0 g/cm$^3$, cooling the reduced iron pellets by water at an average cooling rate between 1,500° C./min and 500° C./min, when the surfaces of the reduced iron pellets are cooled from 650° C. to 150° C., and recovering the reduced iron pellets after cooling.

In the method for manufacturing reduced iron pellets according to the present invention, the reduced iron may be cooled by water at an average cooling rate between 700° C./min and 500° C./min.

The method described above does not require expensive facilities and can manufacture the reduced iron pellets having high degree of metallization, superior crushing strength, and an apparent density of not more than 4.0 g/cm$^3$.

DESCRIPTION OF THE PREFERRED EMBODIMENT

Figure 1:
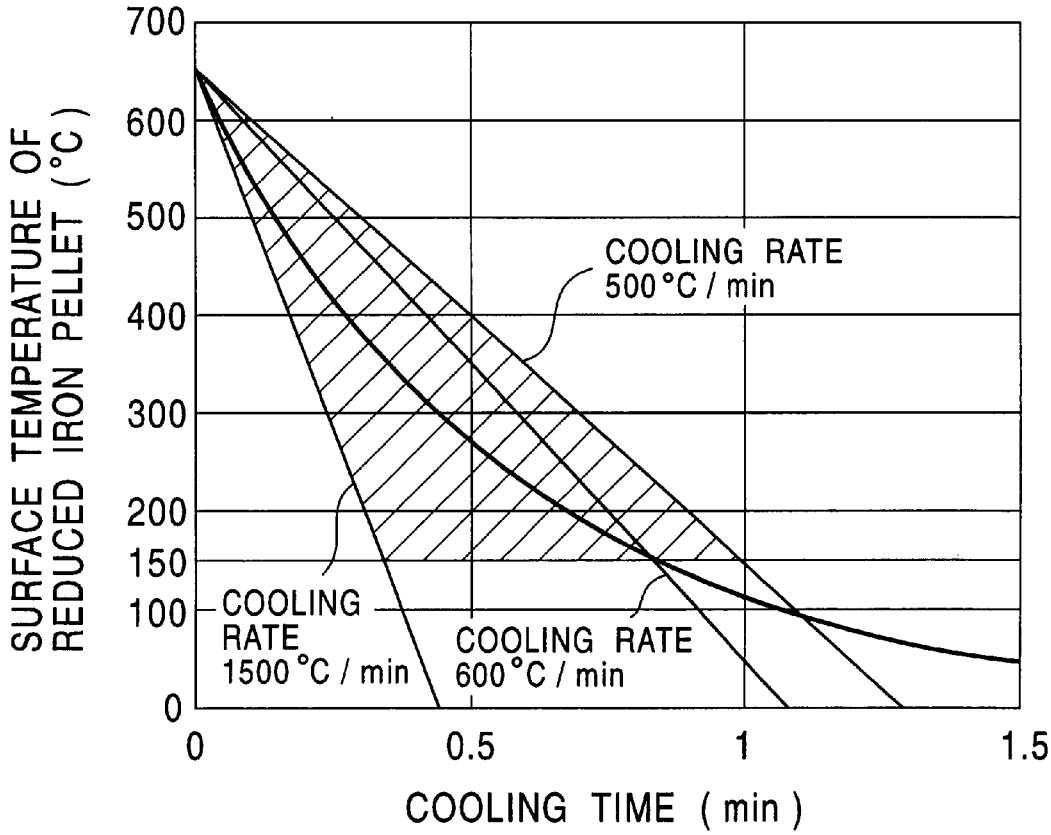
FIG. 1 shows cooling conditions according to the present invention.

In FIG. 1, which shows cooling conditions according to the present invention, the solid curved line of temperature drop represents an example of change in surface temperature of reduced iron pellets from 650° C. to 150° C. when the cooling rate is 600° C./min. A range of the cooling rates between 500° C./min and 1,500° C./min according to the present invention is an average cooling rate from 650° C. to 150° C. of the reduced iron pellets. However, brief cooling rates, which are higher than the upper limit and lower than the lower limit of the above range are not to be excluded.

An acceptable range of the average cooling rate of the present invention is 500° C./min as a lower limit and 1,500° C./min as an upper limit. In the above range, the preferable cooling rate is between 500° C./min and 700° C./min, and the most preferable cooling rate is approximately 600° C./min. When the cooling rate is not higher than 500° C./min, there are problems in that degree of metallization of the reduced iron pellets is decreased by reoxidation thereof, and a longer conveyor to water-cool the pellets requires enormous facilities. In contrast, when the cooling rate is not less than 1,500° C./min, there are the problems in that residual stresses remain in the quenched reduced iron pellets and cracks tend to readily occur therein, thereby decreasing crushing strength.

The reduced iron pellets manufactured by the present invention have an apparent density of not more than 4.0 g/cm$^3$. When the apparent density exceeds 4.0 g/cm$^3$, since the crushing strength thereof is inherently high, significant reduction in the crushing strength caused by cooling is not observed. Accordingly, there is no substantial advantage in applying the cooling conditions of the present invention to the reduced iron pellets described above.

EXAMPLE 1

Agglomerates incorporating carbonaceous material shown in Table 1 were prepared by blending dust generated from converters and blast furnaces with binder in an amount of 1 to 3 percent of the dust. Tests for evaluating the effects of water-cooling rates on the qualities of the pellets, when the agglomerates were cooled from a surface temperature of 1,300° C. using a small furnace in a laboratory, were performed. The results are shown in FIG. 2 and FIG. 3.

Figure 2:
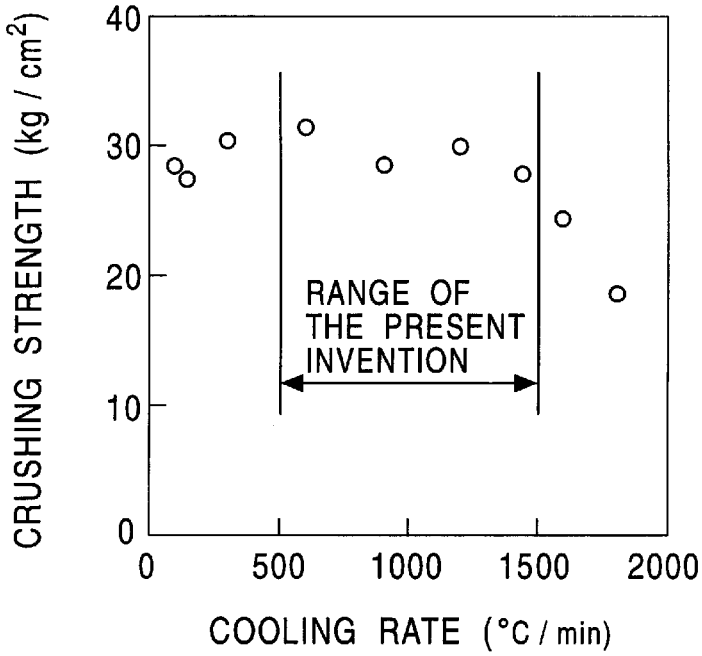
FIG. 2 shows the relationship between cooling rate and crushing strength in Example 1.

As shown in FIG. 2, when the cooling rate exceeds 1,500° C./min, the crushing strength decreases rapidly. The reasons for this are believed to be that internal stresses in the pellets remain when the reduced iron pellets are quenched, microscopic cracks are generated therein, and the pellets therefore break readily after receiving only a small impact. The measurement method for the crushing strength described above is in accordance with the Japanese Industrial Standard (JIS) M 8718.

Figure 3:
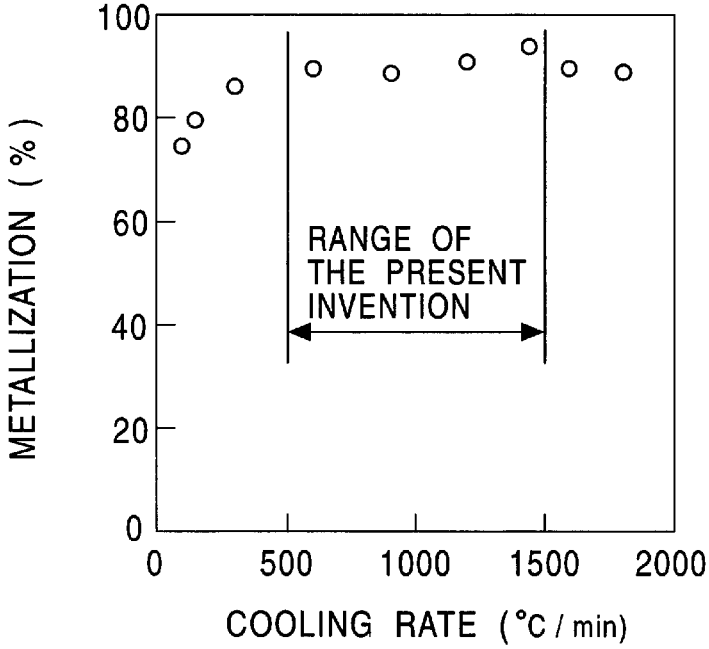
FIG. 3 shows the relationship between cooling rate and degree of metallization in Example 1.

As shown in FIG. 3, when the cooling rate is not more than 500° C./min, the degree of metallization of the pellets decreases. The reasons for this are believed to be that a contact time of the agglomerates with cooling-water becomes longer concomitant with the decreased cooling rate, thereby increasing the tendency that the agglomerates will be reoxidized.

TABLE 1

| Total Fe | Metallic Fe | $SiO_2$ | CaO | Dry weight % Carbon |
|---|---|---|---|---|
| 54.7 | 4.6 | 3.27 | 5.24 | 8.9 |

EXAMPLE 2

In a manner similar to that described in Example 1, agglomerates were prepared by using the dust, as shown in Table 1and tests for evaluating effects of water-cooling rates for the agglomerates to qualities thereof were performed using a demonstration furnace. The results are shown in FIG. 4 and FIG. 5.

Figure 4:
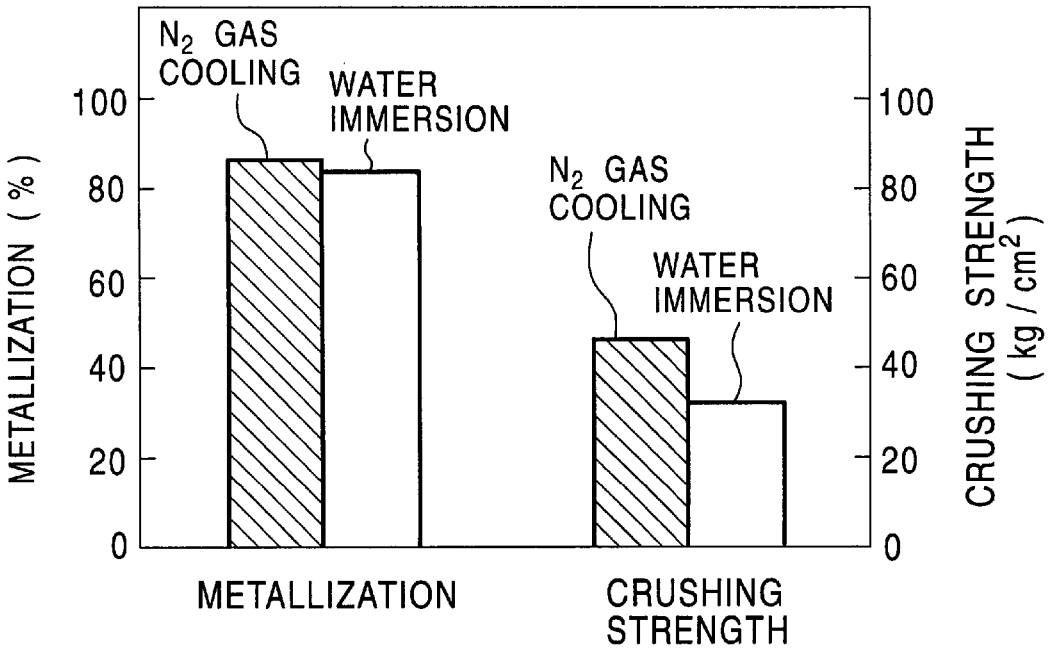
FIG. 4 shows change in quality of reduced iron pellets in Example 2.

FIG. 4 shows changes in qualities of the reduced iron pellets when quenching by immersion in water in a water-cooling bath (water immersion, a cooling rate not less than 1,500° C./min) was performed for the reduced iron pellets discharged from a reduction furnace. Compared to the results obtained by cooling with nitrogen gas, the degree of metallization and the crushing strength decreased by 2 to 5%, and by 10 to 20 kg/cm$^2$, respectively. In view of these results, it is not desirable to quench the hot reduced iron pellets immediately after the discharge from the reduction furnace since degradation of metallization and crushing strength are increased.

Figure 5:
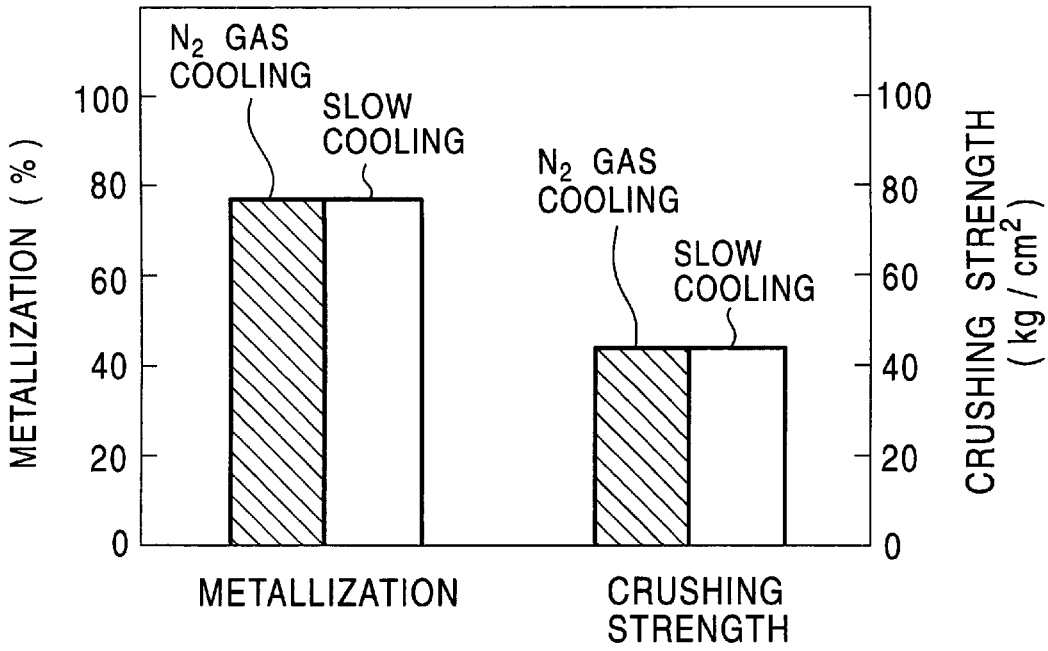
FIG. 5 shows change in quality of the reduced iron pellets in Example 2.

FIG. 5 shows changes in qualities of the reduced iron pellets when the reduced iron pellets discharged from a reduction furnace at a temperature of 650° C. were slowly cooled by cooling-water at a rate of 600° C./min. Compared to the results obtained by cooling with nitrogen gas, the degree of metallization and the crushing strength of the reduced iron pellets were similar to those cooled with nitrogen gas.

From the results in Example 1 (a small furnace in a laboratory) and Example 2 (a demonstration furnace), it can be seen that when the reduced iron pellets are cooled with water, the qualities thereof are degraded by quenching at a rate of not less than 1,500° C./min. In contrast, when slow cooling is performed at a rate of not more than 500° C./min, reoxidation of the reduced iron pellets occurs and the degree of metallization thereof decreases. Accordingly, when water-cooling is performed at a rate between 500° C./min and 1,500° C./min, the reduced iron pellets having desirable qualities thereof can be recovered by cooling.

EXAMPLE 3

Agglomerates incorporating carbonaceous material composed of 78.3% of iron ore, 20.0% of coal, and 1.7% of binder by weight as shown in Table 2 were prepared, and agglomerates of the reduced iron were manufactured in a reduction furnace. When the reduced iron pellets discharged from the furnace was cooled with water from 650° C. at a rate of 600° C./min, the degree of metallization and the crushing strength were similar to those obtained by nitrogen gas cooling. The data obtained are shown in Table 3. As described thusfar, when the cooling rate at the surfaces of the reduced iron pellets is controlled, the qualities of the reduced iron pellets manufactured from the agglomerates incorporating carbonaceous material composed of iron ore, powdered coal, and the like, were not degraded by water-cooling, in a manner similar to that manufactured from ironwork dust.

TABLE 2

| | Total Fe | $SiO_2$ | $Al_2O_3$ | Fixed carbon | Volatile content | Dry weight % Ash content |
|---|---|---|---|---|---|---|
| Iron ore | 67.9 | 1.0 | 0.5 | | | |
| Coal | | | | 72.6 | 18.8 | 8.6 |

TABLE 3

| Cooling method | Degree of metallization (%) | Crushing strength (kg/cm$^2$) |
|---|---|---|
| Example of the present invention | 91.2 | 41.5 |
| Nitrogen gas cooling | 91.6 | 40.9 |

In the Examples described above, the uniform cooling of the surface temperature of the reduced iron pellets is described; however, the present invention is not limited to this. For example, cooling may be performed by repeated temperature decreases with water-cooling and repeated temperature increases in a stepwise or saw-thoothed manner.

What is claimed is:

1. A method for manufacturing reduced iron pellets, comprising the steps of:

heating iron oxide pellets incorporating carbonaceous material in a reduction furnace, to yield the reduced iron pellets having an apparent density of not more than 4.0 g/cm$^3$;

discharging the reduced iron pellets from the reduction furnace; and cooling the reduced iron pellets using water at an average cooling rate between 1,500° C./min and 500° C./min, when the surfaces of the reduced iron pellets are cooled from 650° C. to 150° C.

2. A method for manufacturing reduced iron pellets according to claim 1, wherein the reduced iron pellets are cooled by water at an average cooling rate between 700° C./min and 500° C./min.

3. A method for manufacturing reduced iron pellets, comprising the steps of heating iron oxide pellets incorporating carbonaceous material, to yield the reduced iron pellets having an apparent density of not more than 4.0 g/cm$^3$, and recovering the reduced iron pellets after cooling, wherein the hot reduced iron pellets are cooled using water at an average cooling rate between 1,500° C./min and 500° C./min, when the surfaces of the reduced iron pellets are cooled from 650° C. to 150° C.

* * * * *